US007789770B1

(12) United States Patent
Li

(10) Patent No.: US 7,789,770 B1
(45) **Date of Patent: *Sep. 7, 2010**

(54) LIGHTWEIGHT TENSIONING ASSEMBLY

(76) Inventor: Laurence Hsiao-Cheng Li, 515 Clark Dr., San Mateo, CA (US) 94402

( * ) Notice: Subject to any disclaimer, the term of this patent is extended or adjusted under 35 U.S.C. 154(b) by 0 days.

This patent is subject to a terminal disclaimer.

(21) Appl. No.: 11/729,445

(22) Filed: Mar. 29, 2007

Related U.S. Application Data

(63) Continuation-in-part of application No. 10/208,109, filed on Jul. 29, 2002, now Pat. No. 7,252,597.

(60) Provisional application No. 60/787,965, filed on Mar. 30, 2006.

(51) Int. Cl.
*A63B 53/08* (2006.01)

(52) U.S. Cl. ..... 473/318

(58) Field of Classification Search ..... 473/286, 473/318

See application file for complete search history.

(56) References Cited

U.S. PATENT DOCUMENTS

| | | | | |
|---|---|---|---|---|
| 5,674,134 | A * | 10/1997 | Blankenship | 473/296 |
| 6,036,281 | A * | 3/2000 | Campbell | 301/104 |
| 6,241,623 | B1 * | 6/2001 | Laibangyang | 473/232 |
| 6,361,451 | B1 * | 3/2002 | Masters et al. | 473/318 |
| 7,134,645 | B1 * | 11/2006 | Johnson et al. | 254/338 |
| 7,252,597 | B2 * | 8/2007 | Li et al. | 473/318 |
| 7,413,147 | B2 * | 8/2008 | Bae | 244/164 |
| 2001/0050323 | A1 * | 12/2001 | Brownell | 244/142 |
| 2004/0102719 | A1 * | 5/2004 | Keith et al. | 600/585 |
| 2005/0059995 | A1 * | 3/2005 | Sepetka et al. | 606/200 |

FOREIGN PATENT DOCUMENTS

EP 1043181 A2 * 10/2000

* cited by examiner

*Primary Examiner*—Stephen L. Blau

(57) ABSTRACT

This invention presents an apparatus for force adjustment within a golf shaft. The apparatus includes load member and a force adjuster and parts for coupling the apparatus to a golf shaft. A lightweight design for the load member is introduced and a method of assembling the apparatus into the golf club shaft is described.

14 Claims, 14 Drawing Sheets

B > A

SECTION B-B

SECTION D-D

LIGHTWEIGHT TENSIONING ASSEMBLY

RELATED APPLICATIONS

This application is a continuation-in-part of U.S. patent application Ser. No. 10/208,109 filed Jul. 29, 2002 and claims priority to U.S. provisional patent application Ser. No. 60/787,965 filed Mar. 30, 2006, the entire content of each of which is incorporated herein by this reference.

FIELD OF THE INVENTION

This invention relates to the field of golf equipment, and more specifically to golf shafts having an adjustable stiffness and frequency.

BACKGROUND

The trend in the golf club industry is towards the construction of customized golf clubs. In customizing a golf club, the physical size of the club should correspond in some way to the size of the golfer. For example, a longer golf club would be suitable for a taller golfer. The weight of the club should also be considered since, in general, a golfer with greater physical strength could swing heavier golf clubs than golfers of lesser strength. These are examples of two factors commonly considered when selecting the proper golf club for a particular individual. Another important parameter to consider is the bending characteristic of the golf club shaft.

The bending of a golf club shaft may be characterized by its bending stiffness and its vibrational bending frequency. The bending stiffness is a measure of how much the golf club shaft will bend (i.e. its displacement) due to an applied force at a specified location on the shaft. If the same force is applied in the same way to two different golf club shafts, the shaft with the smaller displacement is considered to be stiffer, as illustrated in FIG. 1A.

The vibrational bending frequency of a golf club shaft is the frequency at which the golf club shaft vibrates when bent and then suddenly released, for example, when being held at the grip end and deflected at the head. Such vibration of the shaft is similar to the motion of a car radio antenna when struck. As the shaft vibrates, the number of times the end of the shaft goes back and forth each minute is the vibrational bending frequency measured in cycles per minute.

It is common for golf clubs to be purchased pre-assembled as a set, with the golfer required to adapt to the golf clubs as purchased. Some golf clubs may be selected off-the-shelf with a particular stiffness specification that the golfer deems appropriate for his or her golfing style. Golf club shafts are currently commercially sold in different bending stiffness specifications. Examples are: "ladies", "senior", "regular," "stiff," and "extra stiff." Each of these specifications relates to a range of bending stiffness values. The exact value of an individual shaft designated with one of the above terms falls somewhere within the range of values described by that specification. Golf club shafts are also described as having high, mid or low kick-points. This describes the location of the shaft exhibiting the greatest rate of deflection when bent and relates to the stiffness characteristics of that shaft. Still another term used in describing the stiffness of a golf club shaft is whether the shaft is tip-stiff or tip-soft. The terminology that the shaft has a "responsive" or "lively" tip refers to golf shafts that have, relatively speaking, greater tip flexibility. The purpose of these various shaft bending stiffnesses is to allow the assembly of a golf club with a vibrational bending frequency or bending stiffness profile that best compliments a golfer's particular swing style and ball flight desires.

One problem with selecting golf clubs with a fixed bending stiffness and vibrational bending frequency is that it is rare for a golfer's swing tempo to precisely match with an off-the-shelf set of clubs. Another problem is that it is also rare for a set of clubs to have physical parameters such as bending stiffness, mass and vibrational bending frequency consistent between each club within a set.

One solution is to provide a custom-made set of clubs where a golf professional or person with technical expertise consults with the golfer prior to the assembly of the golf club. The consultant chooses the golf club shaft bending stiffness and stiffness distribution, length and head weight to best suit the individual golfer.

A problem with providing a custom set of clubs is that commonly only a range of discrete vibrational bending frequencies and bending stiffness profiles are attainable. Furthermore, the range of discrete vibrational bending frequencies and bending stiffness profiles may not be available at all for certain combinations of shaft length and head weight. In addition, once the club is assembled, the vibrational bending frequency and bending stiffness profile cannot be easily changed without re-manufacturing the golf club.

Some prior golf club shafts are designed to provide very specific shaft bending stiffnesses at different locations along the shaft's length. One prior golf club shaft uses an interior bar within a hollow shaft, and a number of coupling inserts to alter shaft stiffness. When engaged, the coupling inserts attach the shaft to the interior bar at the coupling insert locations, thus increasing the overall stiffness of the club.

Another prior golf club design provides the capability of changing the shaft stiffness of a golf club after it has been assembled. This is accomplished by pressurizing the shaft with air, which changes the golf club's stiffness.

While these prior golf clubs provide the individual golfer with the capability of changing the bending stiffness and the vibrational bending frequency of a given set of clubs after the clubs have been assembled and purchased, the present invention provides a solution with greater adjustment range, lighter weight, improved reliability and safety and a process for assembling the product repeatably.

SUMMARY OF THE INVENTION

The present invention pertains to an apparatus for force adjustment within a golf shaft. The apparatus includes load member and a force adjuster and parts for coupling the apparatus to a golf shaft. A lightweight design for the load member is introduced and a method of assembling the apparatus into the golf club shaft is described.

Additional features and advantages of the present invention will be apparent from the accompanying drawings and from the detailed description that follows.

BRIEF DESCRIPTION OF THE DRAWINGS

The present invention is illustrated by way of example, and not by way of limitation, in the figures of the accompanying drawings in which.

DETAILED DESCRIPTION

In the following description, numerous specific details are set forth, such as examples of specific materials, mechanisms, dimensions, etc., in order to provide a thorough understanding of the present invention. It will be apparent, however, to one skilled in the art that these specific details need not be employed to practice the present invention. In other instances, well known materials or methods have not been described in detail in order to avoid unnecessarily obscuring the present invention.

An apparatus for force tuning within a golf shaft is described herein. In one embodiment, the apparatus includes a tapered golf shaft having a bending stiffness profile and a vibrational bending frequency. A load member is coupled to the tapered golf shaft. The load member allows for the bending stiffness and the vibrational bending frequency to be altered. Such alteration may occur after the apparatus is assembled.

The method and apparatus described herein is preferably implemented with a golf club as discussed in detail below. Although the method and apparatus are described in relation to a golf club, this is only for illustrative purposes and is not meant to be limited to use in a golf club but can also be used with other devices having shafts or beams.

Figure 1A:
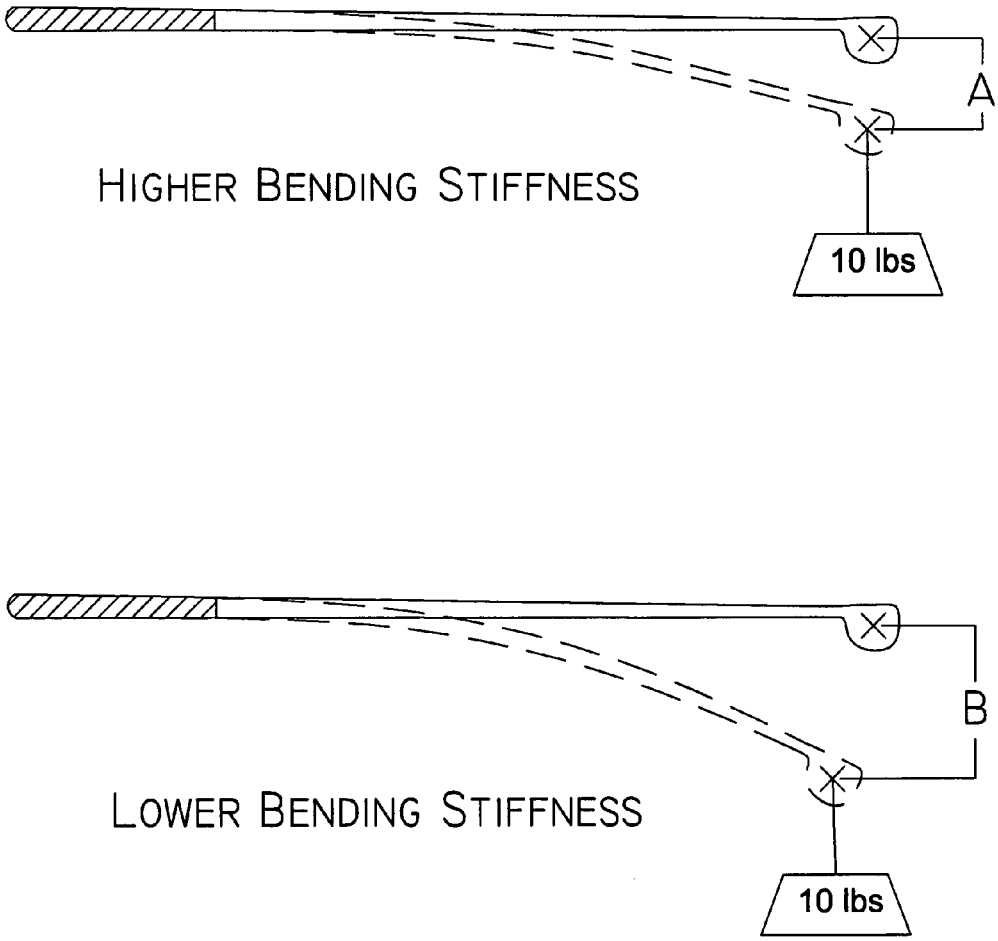
FIG. 1A illustrates the principles of bending stiffness.
Figure 1B:
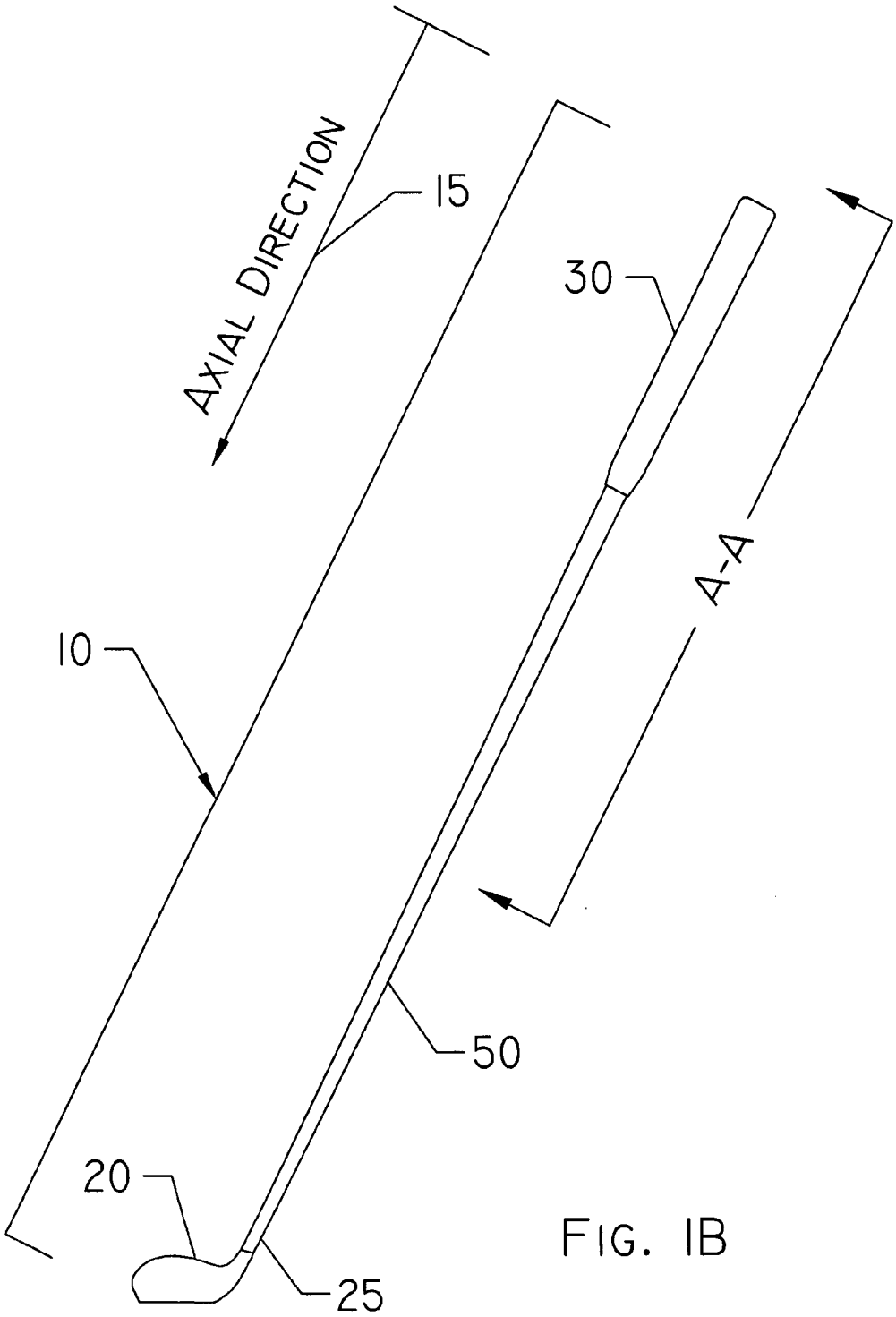
FIG. 1B defines various parts of a golf club.

FIG. 1B illustrates one embodiment of a golf club having a force tuning device. Golf club 10 includes a head 20 and a tapered shaft 50. The shaft 50 has a head or tip end 25 and a handle or butt end 30. Head end 25 may be coupled to head 20. In one embodiment, handle end 30 is an area of golf shaft 50 by which a user typically holds a golf club 10. The handle end 30 may be wrapped in a material suitable for gripping by the user. In another embodiment, handle end 30 may be coupled to a separate handle piece. The axial direction 15 is along the length of golf club 10.

The performance of golf club 10 may be characterized by parameters such as its bending stiffness and its vibrational bending frequency. The bending stiffness of shaft 50 is a measure of how much the shaft will bend due to an applied force at a specified location. The vibrational bending frequency of shaft 50 is the frequency at which shaft 50 vibrates when bent and then suddenly released, for example, when being held at handle 30 and deflected at head 20. As tapered shaft 50 vibrates, the number of times that head end 25 moves back and forth, per a unit of time period, is its vibrational bending frequency.

Figure 2:
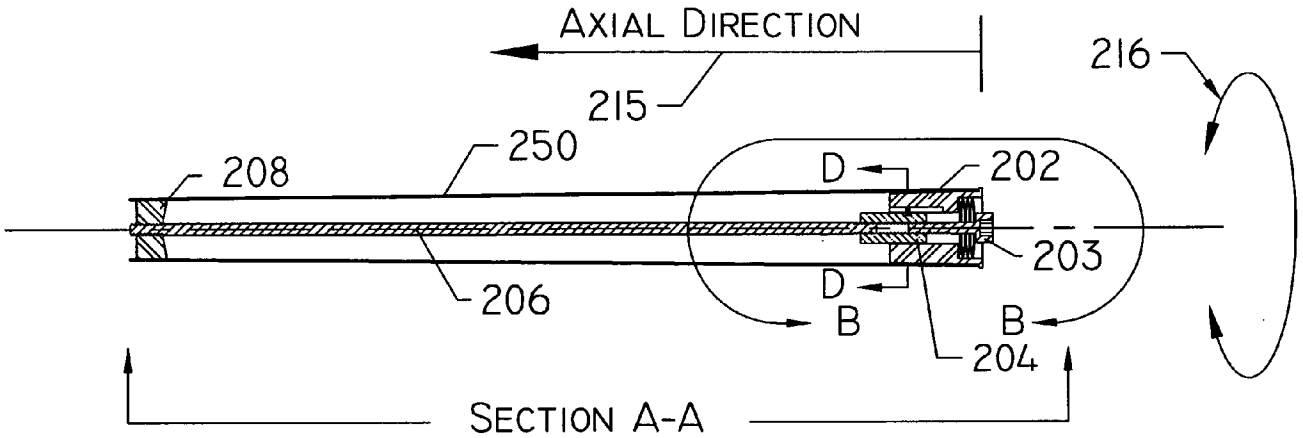
FIG. 2 illustrates a cut through view of one embodiment of a golf shaft with a tensioning assembly installed.

FIG. 2 illustrates a cut through view of the butt end of a tapered shaft. The section A-A of FIG. 2 corresponds to the butt end of section A-A of FIG. 1B. The hollow shaft has a circular cross sectional structure and contains the mechanism for adjusting the stiffness and frequency of the shaft.

In one embodiment, the butt end of the hollow tapered shaft includes inner insert 208 and outer insert 202. The size and diameter of inserts 202 and 208 may be designed to provide coupling within shaft 250 at a desired location along the hollow shaft. Inserts 202 and 208 are positioned within shaft 250 along the region where stiffness of the shaft is to be adjusted. In one embodiment, outer insert 202 may be coupled to the shaft 250 at the butt and inner insert 208 may be coupled to shaft 250 at the approximate center or bend point of the shaft. In an alternative embodiment, the outer insert may be coupled at other positions within the end of the shaft.

In one embodiment, inserts 202 and 208 may be coupled to shaft 250 by bonding. In an alternative embodiment, inserts 202 and 208 may be constrained within shaft 250 by other methods, for example, integrally manufactured into shaft 250.

A load member 206 extends between inserts 202 and 208. Load member 206 may be coupled to inner insert 208 at one end. The other end of load member 206 may be coupled to outer insert 202. In one embodiment, load member 206 carries a tension load between the inserts 202 and 208 so that the section of shaft 250 between inserts 202 and 208 may be subjected to compression along its axial direction 215. The load member extends along the central or neutral axis of the shaft spaced from the walls.

In one embodiment, load member 206 is a rod. In alternative embodiments, load member 206 may be another type of elongated structural member capable of carrying a tension force along axial direction 215 of shaft 250, for example, a tube or a cable. Load member 206 may be constructed of a tension retaining material that does not exhibit significant time degradation or creep that would lessen the amount of force carried. Creep refers to the property of a material whereby the physical dimension of the loaded part changes as a function of time as well as load. Steel, aluminum, titanium, invar, carbon fiber composites and boron fiber composites are examples of such materials that are highly resistant to creep. In an alternative embodiment, load member 206 may be configured to carry a compressive load.

The inserts and the load member are not limited only to the configuration illustrated in FIG. 2. As previously discussed in an alternative embodiment, the inserts 202 and 208 may be located along the shaft at different locations in order to target the stiffness along prescribed regions of its length.

Referring again to FIG. 2, in one embodiment a load adjuster 203 is coupled to load member 206 via coupler 204. Tuning of the bending stiffness and vibrational bending frequency of shaft 250 may be performed at any time through use of load adjuster 203. In one embodiment, the tuning may be performed by turning load adjuster 203 in a rotational direction 216. Rotating load adjuster 203 produces a tension force in load member 206 and an opposite compression force on the shaft 250, as illustrated in FIG. 3.

Figure 3:
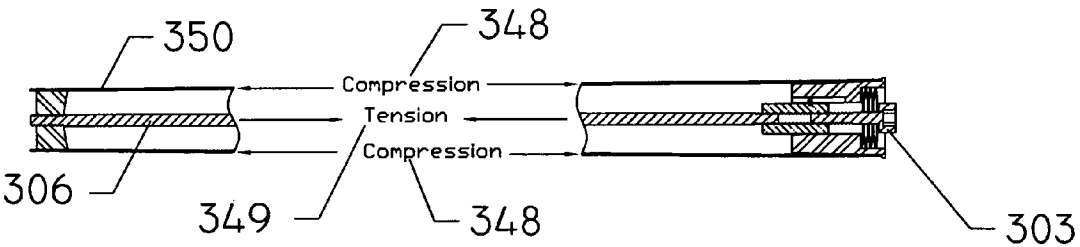
FIG. 3 illustrates one embodiment of the internal forces within a golf shaft with a tensioning assembly installed.

FIG. 3 illustrates one embodiment of the internal forces within a shaft. Changes in the bending stiffness and vibrational bending frequency of shaft 350 is related to the axial force applied to it. A force 348, that is, a compression load, in shaft 350 causes a decrease in its bending stiffness and a corresponding decrease in its vibrational bending frequency. Conversely, a reduction in the compressive force 348 in the shaft 350 causes a corresponding increase in the vibrational bending frequency, up to the properties of a shaft without the tensioning member 306 installed. As such, a user may reversibly and repeatably tune shaft 350 to a desired frequency by moving load adjuster 303.

A golfer may quickly tune the golf club to a preferred setting by turning load adjuster 303 to try the golf club at various vibrational bending frequencies or with different bending stiffness profiles. In another embodiment, the vibrational bending frequency of a golf club having shaft 350 may be measured quantitatively and correlated to a calibration scale on the shaft. This provides an indicator by which a golfer can visually adjust the parameters of the shaft to a given setting.

Figure 4:
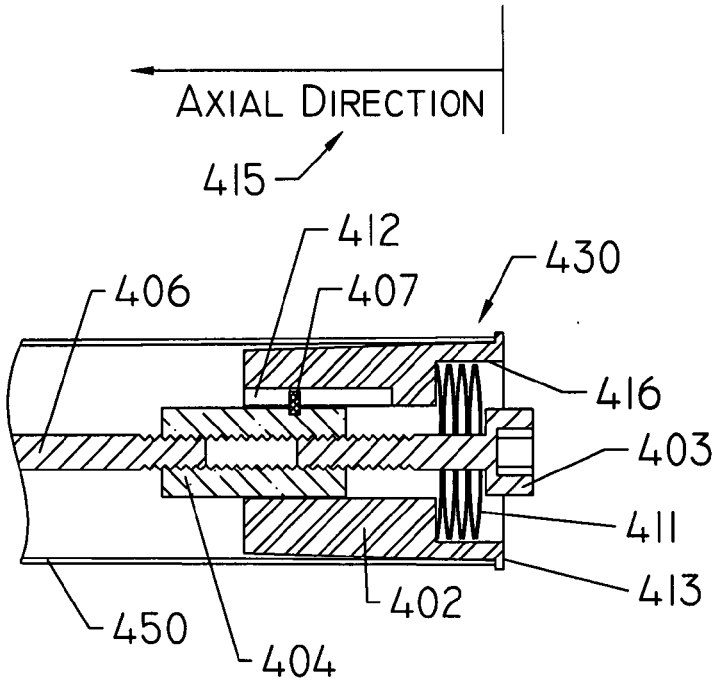
FIG. 4 illustrates one embodiment of an adjuster for adjusting the bending stiffness and vibrational bending frequency of a golf shaft.

FIG. 4 illustrates one embodiment of an adjuster for a force tuning device. In one embodiment, outer insert 402 is disposed within end 430 of shaft 450. One end of insert 402 has a lip 413 that transitions to a larger diameter than shaft 450. The edge of lip 413 seats insert 402 against shaft 450 when installed, and prevents insert 402 from dropping into the cavity of shaft 450. As such, insert 402 provides a firm attachment point to body 450 for additional components.

In one embodiment, load member 406 is attached to a coupler 404 that may be placed in insert 402. Load adjuster 403 is attached to coupler 404 from a side opposite that of load member 406. Load member 406 extends between insert 402 and another insert (not shown) within shaft 450. Load member 406 carries a tension load so that the section of shaft 450 between the inserts places that section into axial compression.

In one embodiment, coupler 404 has a coupler key 407 that fits into keyway slot 412. Keyway slot 412 allows coupler 404 and load member 406 to move along the axial direction 415 of shaft 450, within insert 402. Keyway slot 412 also prevents relative rotation between coupler 404 and insert 402 about the axial direction 415 of shaft 450.

Figure 5A:
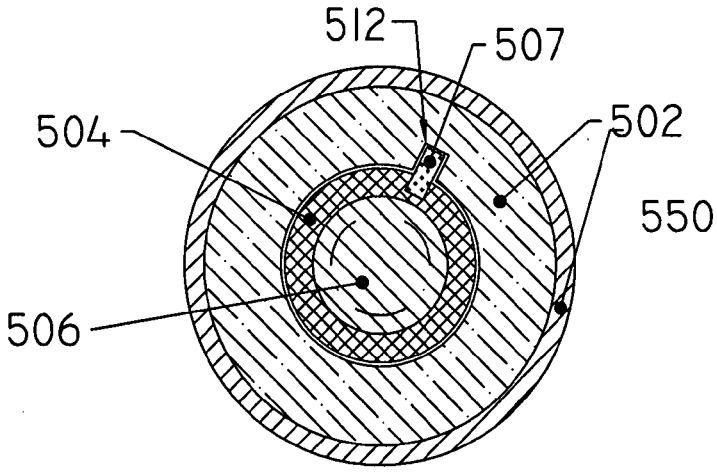
FIG. 5A illustrates a cross section of one embodiment of a golf shaft.
Figure 5B:
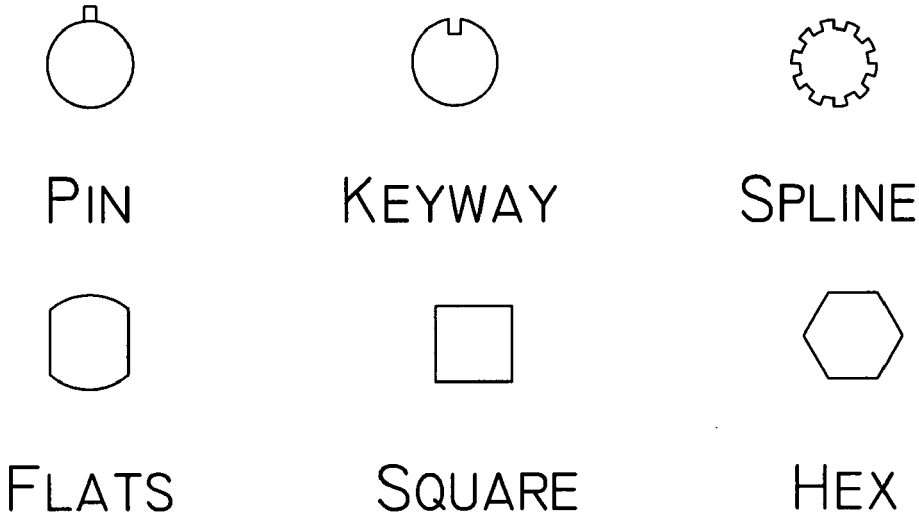
FIG. 5B illustrates cross sections of alternative embodiments of a coupler.

FIG. 5A illustrates a cross section of one embodiment of a shaft. Load member 506 is attached to coupler 504 that is inserted into insert 502. In one embodiment, coupler 504 has a non-circular cross-section such that a pin 507 resides at one point along its circumference. Insert 502 has a correspondingly sized keyway 512 disposed within it that will accept pin 507. Keyway 512 prevents the rotation of coupler 504 when the load adjuster (e.g. load adjuster 403 of FIG. 4) is turned. This forces coupler 504 to slide up and down within insert 502 (i.e. into and out of the page) in response to the amount of tension being applied by the load adjuster (not shown). In another embodiment, coupler 504 may be formed as an integral part of load member 506. In alternative embodiments, coupler 504 may have other configurations to allow for axial motion of load member 506 (into and out of the page) while preventing rotation, for example, a spline, a flat, a square and a hex, as illustrated in FIG. 5B.

Referring again to FIG. 4, coupler 404 is coupled to load adjuster 403. In one embodiment, coupler 404 may be a screw mechanism. Coupler 404 may have male or female threads where it attaches to load adjuster 403. Turning load adjuster 403 in one direction causes coupler 403 to bring load member 406 and load adjuster 403 closer together. This movement produces a tension force in load member 406 and an opposite compression force in shaft 450, similar to that discussed above in relation to FIG. 3.

Figure 5C:
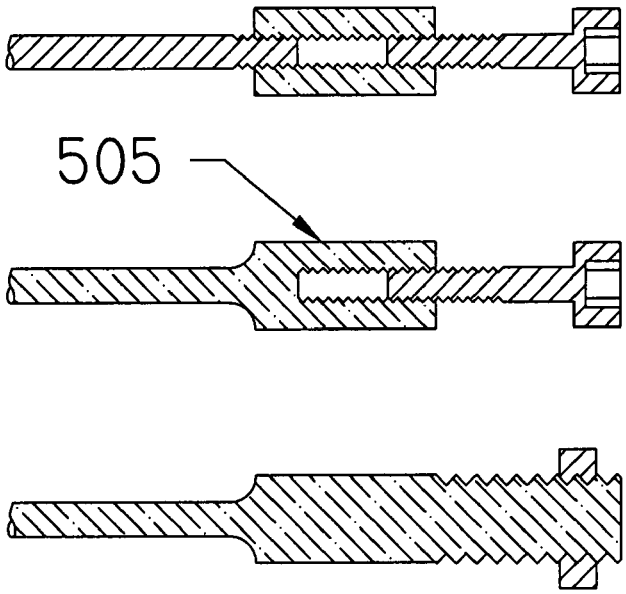
FIG. 5C illustrates alternative embodiments of a screw mechanism.

Various configurations of a screw mechanism are illustrated in FIG. 5C. For example, the load member and coupler may be integrated into one component 505 of FIG. 5C. In an alternate embodiment, adjuster 403 may be another type of mechanism for providing an axial load to load member 406, for example, a cam mechanism. Screw and cam mechanisms are well known in the art; accordingly, a more detailed description of their operation is not provided herein.

As such, the tuning of the bending stiffness profile and the vibrational bending frequency of shaft 450 may be performed by adjusting load adjuster 403. In addition, this tuning procedure may be performed at any time after the assembly of the components within shaft 450. The use of a linear screw mechanism enables the bending stiffness and vibrational bending frequency to be adjusted over a continuous range of values, rather than just a few discrete values. In an alternative embodiment, a non-linear mechanism may be used to provide adjustment in a discrete range of values, for example, a ratchet mechanism.

In one embodiment, spring 411 may be positioned between load adjuster 403 and insert 402 to provide approximately a constant tension in shaft 450, regardless of the amount of bending deflection of shaft 450. In one embodiment, spring 411 may be belleville springs for compactness, as shown in FIG. 4. In alternative embodiments, spring 411 may have other designs, for example, it may be a compressive or extensive coil spring. Spring 411 may be soft enough so that it would provide a relatively large ratio in the adjustment of load adjuster 403 to the force transmitted to load member 406. As such, changes in the force that produces tension on load member 406 may be easily controlled with broad tolerance on the adjustment requirement of load adjuster 403. This increases the robustness of the design.

Without spring 411, very small changes in adjustment of load adjuster 403 may create very large tension forces if load member 406 is relatively stiff. In another embodiment, the selection of a sufficiently compliant load member 406 may reduce or eliminate the need for spring 411. Spring mechanisms are well known in the art; accordingly, a more detailed description of their operation is not provided herein.

A calibrated scale 416 may be used to provide a visual indication of the stiffness and frequency setting. In one embodiment, calibrated scale 416 may be etched on the inner surface of insert 402 and viewed as load adjuster 403 is adjusted. In alternative embodiments, calibrated scale 416 may be positioned at other locations to allow for a user to visually inspect the scale. For example, calibrated scale 416 may be positioned on the outside surface of shaft 450, with a window slot cut in shaft 450 and insert 402 such that the position of load adjuster 403 may be visible from the exterior of shaft 450.

Figure 6:
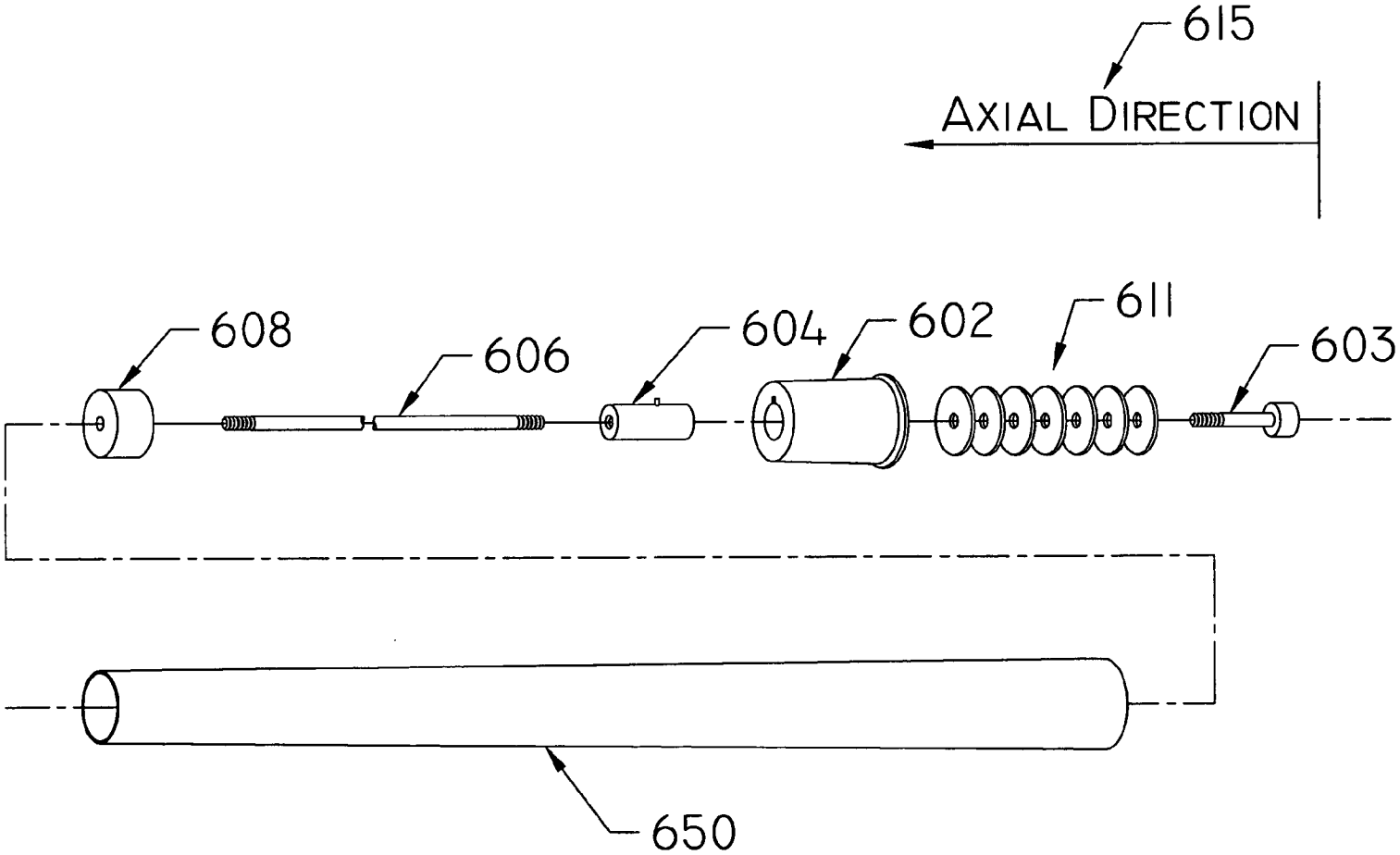
FIG. 6 illustrates an exploded view of one embodiment of a tensioning assembly contained within a golf shaft.

FIG. 6 illustrates an exploded view of one embodiment of a stiffness and frequency tuning device within a shaft. In one embodiment, insert 608, load member 606, coupler 604, insert 602, spring 611 and load adjuster 603 may be assembled independent of shaft 650. The assembled components may then be slid into shaft 650 having a bonding agent pre-applied in appropriate locations to bond the inserts. In one embodiment, insert 608 may be installed in shaft 650 by bonding insert 608 with a high strength adhesive such as an epoxy. In another embodiment, insert 608 may be coupled to shaft 650 by other methods, for example, by integrally forming the insert into the shaft.

Figure 7:
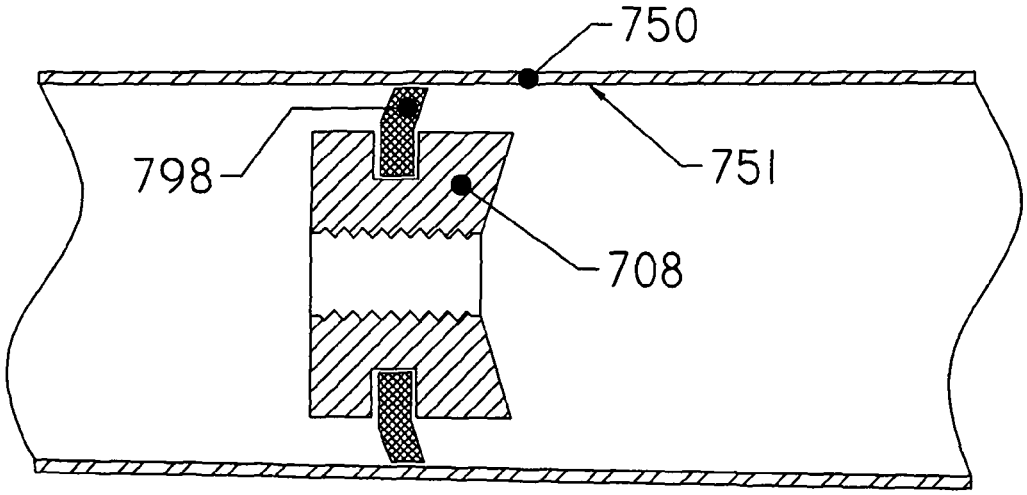
FIG. 7 illustrates an alternative embodiment of insert assembly in a golf shaft.

FIG. 7 illustrates an alternative embodiment of an insert assembly in a shaft. Insert 708 may be a self-locking insert having gripping teeth 798 disposed around its outer surface. Self-locking insert 708 may be pressed into shaft 750 until gripping teeth 798 bite into the inner surface 751 of shaft 750. By using a self-locking insert, a bonding agent may not be necessary to anchor insert 708 into shaft 750. In another embodiment, self-locking insert 708 may have other configurations, for example, the self-locking insert may be threaded to accept a load member, have a hole to accept a load member anchored by some other means, or be integrally attached to the load member.

The installation methods illustrated in FIGS. 6 and 7 may be performed on readily available shafts without the need to alter the shaft other than by attaching the force tuning device.

Figure 8:
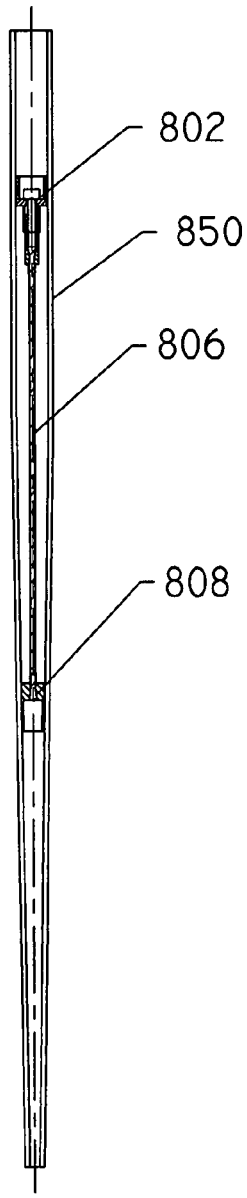
FIG. 8 illustrates a cut through view of an untrimmed golf shaft with a tensioning assembly installed.
Figure 9:
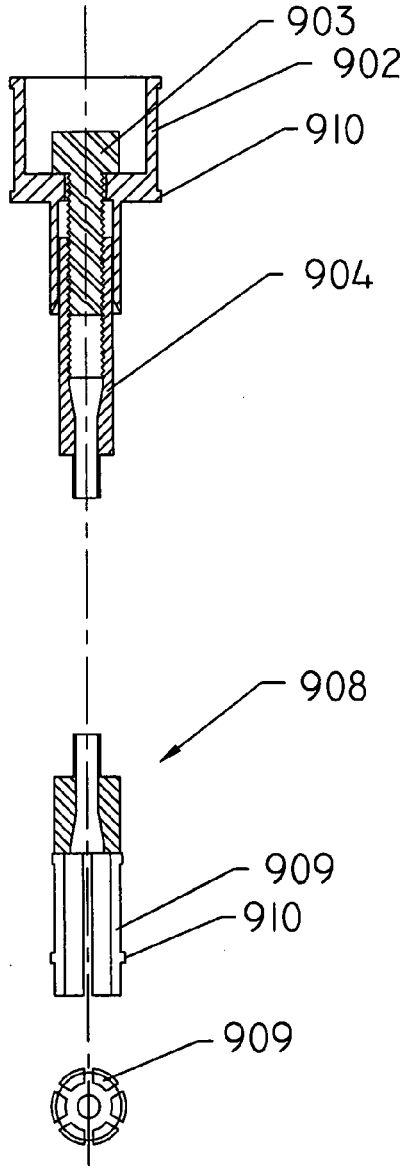
FIG. 9 illustrates another embodiment of an adjuster for adjusting the bending frequency of a golf club, and a diameter compensating inner insert.
Figure 10:
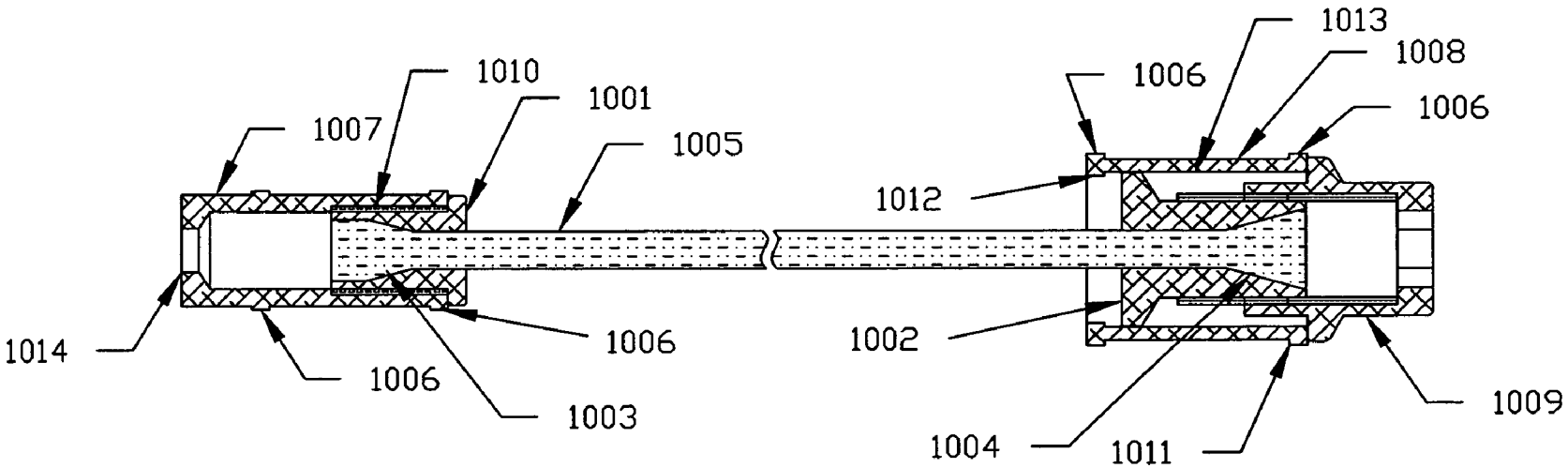
FIG. 10 illustrates an embodiment of a lightweight fiber tensioning assembly.
Figure 11:
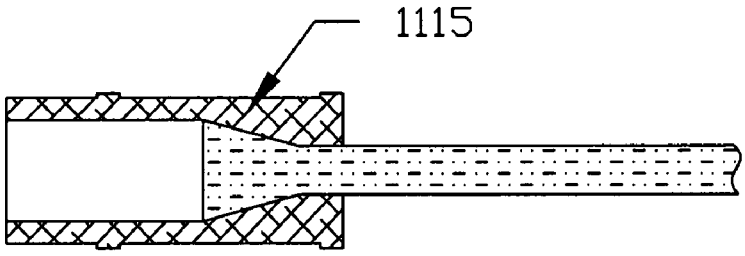
FIG. 11 illustrates an embodiment of a one piece inner insert
Figure 12:
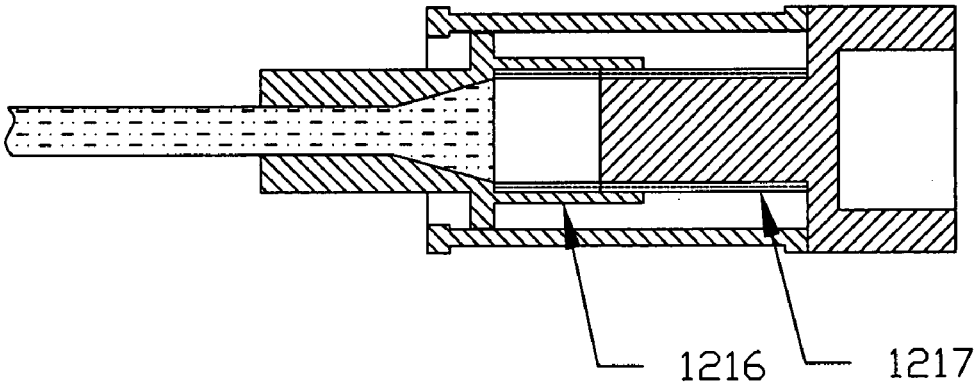
FIG. 12 illustrates an alternate embodiment of an adjuster assembly
Figure 13:
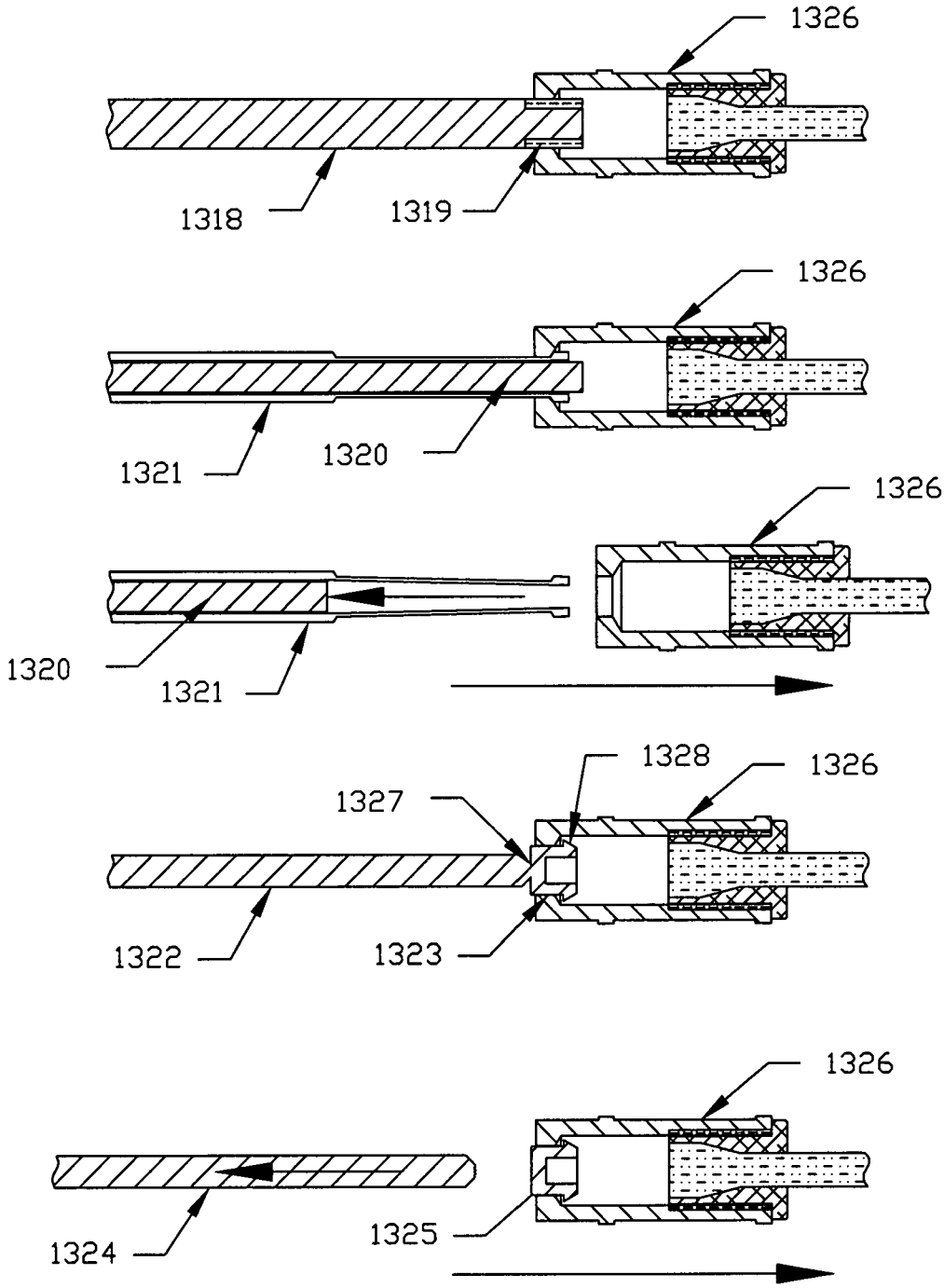
FIG. 13 illustrates an embodiment of an installation tool for assembling the tensioning assembly into the golf club shaft.
Figure 14:
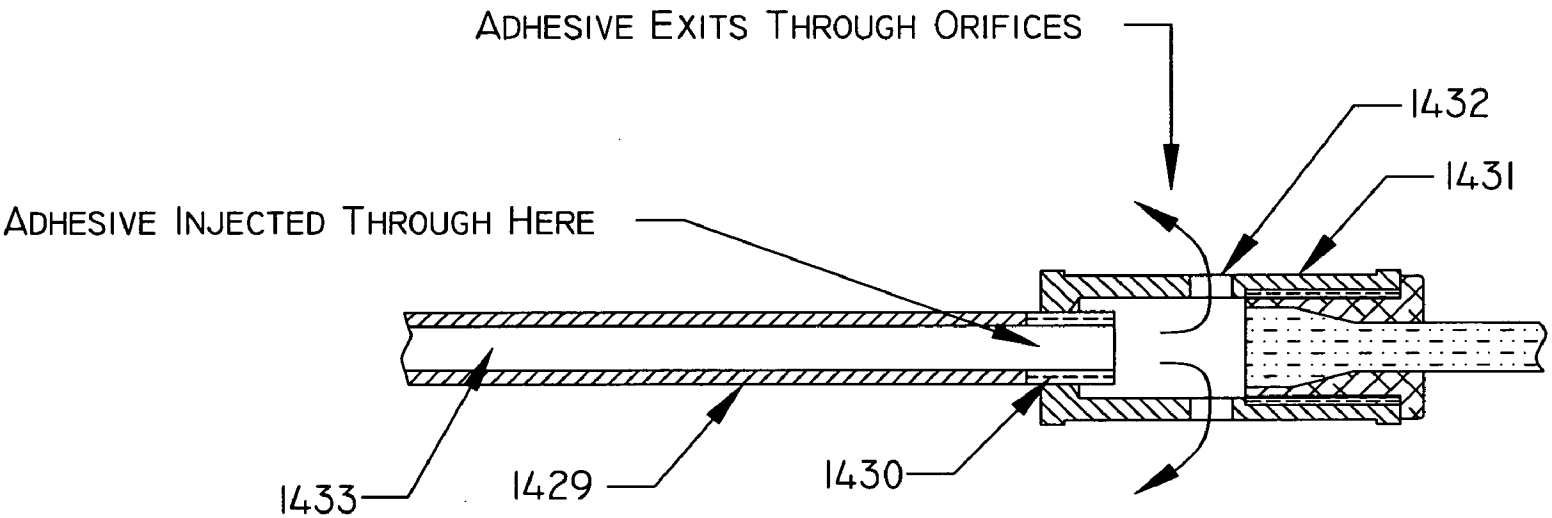
FIG. 14 illustrates an embodiment of an installation tool with an adhesive injection feature.
Figure 15:
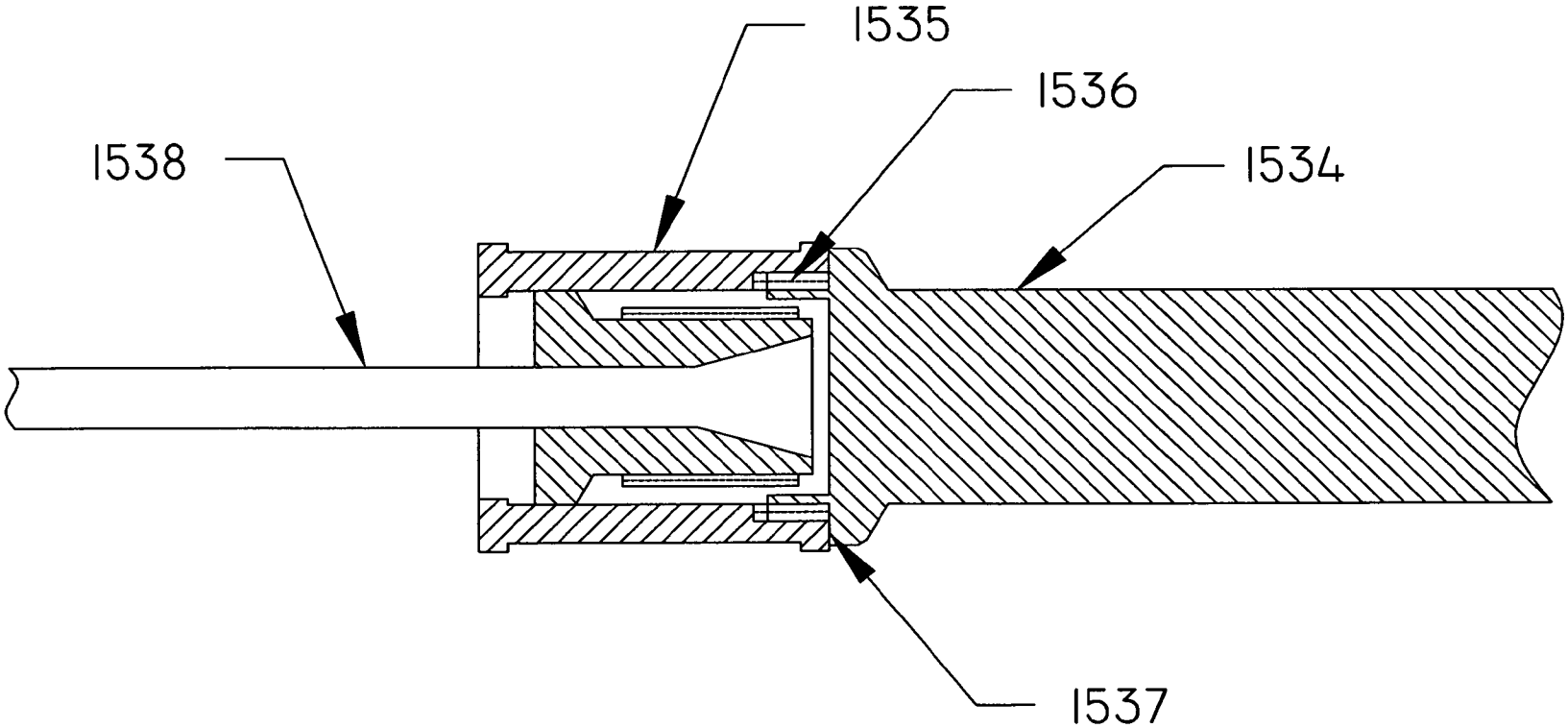
FIG. 15 illustrates an embodiment of an installation tool to assist in positioning the outer insert of the tensioning assembly.
Figure 16:
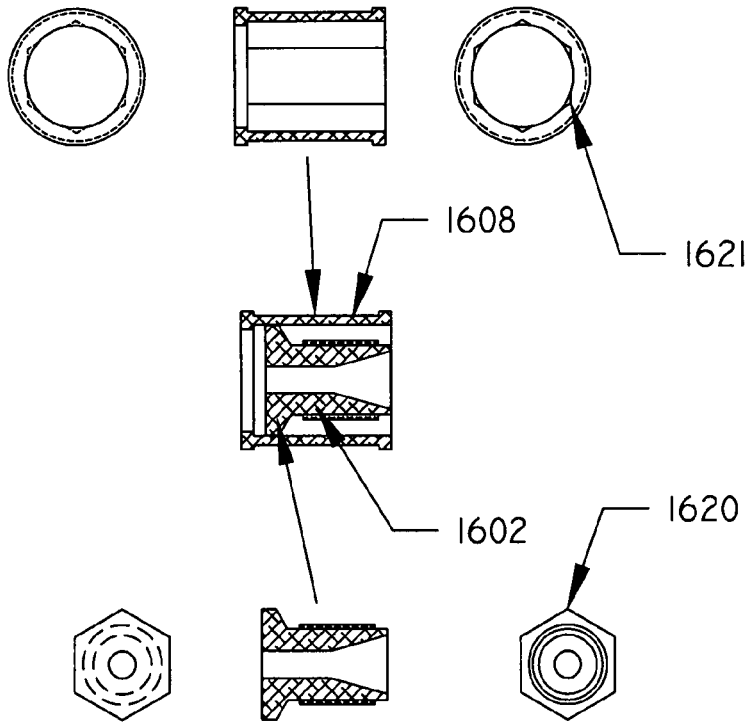
FIG. 16 illustrates the non-circular shapes of the adjuster components necessary to prevent rotation.
Figure 17:
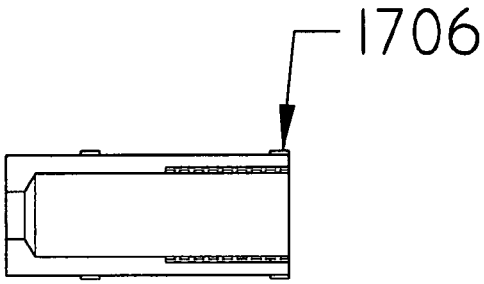
FIG. 17 illustrates an inner insert with rings created by the application of tape to the outside surface of the inner insert.
Figure 18:
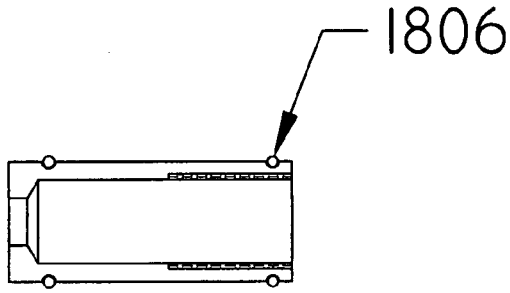
FIG. 18 illustrates an inner insert with rings created by installing o-rings into grooves formed on the outside of the inner insert.

In the foregoing embodiments, it was assumed that the hollow tapered shaft had been trimmed to the final length before the tensioning assembly was mounted. In production, this may not be practical. FIG. 8 shows an embodiment where the outer insert 802 is installed a suitable distance in from the butt of the uncut shaft. This would allow the club assembler the ability to tip and butt trim the shaft to fit the particular club. Contrary to the current reason for tip and butt trimming, which is to select the proper portion of the raw shaft in order to achieve a desired flex, the purpose of tip trimming in this embodiment would be to position the bend point a select distance from the head and then allow the butt to be trimmed to the final desired club length. The inserted distance will depend upon each particular beginning shaft length. It should be such as to allow the assembler to trim the butt end of the shaft. This embodiment enables the clubmaker to assemble the golf club using exactly the same techniques that are currently employed, with the exception that final shaft stiffness is adjustable therefore simplifying the selection of the proper shaft flex for the particular golf club. This attribute makes this golf club shaft a direct replacement of the shafts currently used. A hollow tapered shaft is shown in FIG. 8 with a tensioning assembly including an inner insert 808 and an outer insert 802 inserted inward from the butt of the shaft. The outer insert and inner inserts are suitably secured to the interior of the shaft as described above. The outer coupler includes a screw 903, FIG. 9, that engages a coupler 904 to tension the load member 806 which is secured to the inner insert. The inner insert is positioned in the vicinity of the bend point region. The one piece inner insert 908 incorporates flexible fingers 909 that bend inward as the inner insert is pushed further down a tapered shaft in order to accommodate the smaller diameter toward the head end of the golf club. Ridges 910 are located at various points along the inner insert in order to ensure a consistent bond line around the circumference of the insert. These ridges can be circumferential or longitudinal or they could even be bumps. As an alternate embodiment, indentations could be placed on the surface of the inner insert in order to accept the bonding agent. These ridges 910 are also incorporated in the outer insert 902.

Another benefit of recessing the outer insert is that the added weight is located closer to the head thereby reducing the feeling of "backweighting." Backweight is the idea of reducing the "head heavy" feeling of the club. Backweighting is undesirable in modern clubs, at least among many current manufacturers that are marketing clubs with extreme head heavy swingweights under the assumption that the more weight you can move to the head, the more powerful will be the impact. This philosophy is not embraced by all golfers, one such golfer being Jack Nicklaus, who always backweighted his clubs.

The manufacturing process described above may be used to replace the current practice of manufacturing several different shaft stiffness types and, thus, may reduce tooling and assembly costs for manufacturers. In addition, the use of an adjustable stiffness and frequency shaft may reduce the inventory of wholesalers and retailers who currently have to carry several shafts with different stiffness specifications to accommodate various users.

Furthermore, when used within a set of shafts, the apparatus described herein may be used to match the frequency between individual shafts so that the entire set may be tuned to a similar desired frequency. In addition, the stiffness and frequency tuning may be accomplished after the set of shafts has been assembled, without strict regard to their initial frequency values.

The structure, function and benefits of an adjustable flex golf club shaft have been explained in detail. While this description may provide sufficient information to create a functional device, what is lacking is the knowledge to produce a truly marketable and practical device. The benefits of specific material selections and the methodology of how they will be used in the construction of a lightweight tension adjusting assembly will be discussed herein as well as the manufacturing method for mass producing adjustable flex golf club shafts.

Several criteria must be met in the selection of material to use in the tension adjusting assembly. Particular attention must be paid to the choice of materials used for the tensioning member.

Lightweight, Strong and Compact

Because of the confined space within a golf club shaft, the tensioning assembly must be compact. This creates the challenge of designing an adjuster that is strong enough to support the necessary loads imparted upon it when the tensioning member is tightened to adjust the flex, while being able to package the adjuster within the golf shaft cavity. It is also desirable to minimize the weight of the tension adjusting assembly to avoid noticeable changes to the weight of the golf club in which the shaft will be used.

An additional benefit of selecting a lighter weight material for use in the tension member is that there is less tension member mass vibrating which increases the vibration frequency of the tension member and reduces the vibration amplitude. This in turn, reduces the likelihood of the tension member hitting the inside wall of the golf club shaft causing a noise at impact.

Resists Creep

Once a golf club is adjusted to a particular flex by tightening the tensioning assembly, there may be an extended period of time of weeks, months, or years before that flex is again adjusted. It is important, therefore, that the pre-set tension is maintained. Thus, another attribute that this tensioning assembly must have is that the assembly cannot creep. While metallic materials tend not to exhibit creep, alternative materials such as polymers do. One polymer suggested in prior art is nylon. Nylon is highly susceptible to creep. Creep is the tendency of a structure to stretch over time when it is supporting a load. In this application, creep would be characterized by the tensioning member losing tension with the passage of time. In order to avoid creep, the proper material must be selected as well as the proper dimension for carrying the anticipated load.

Thermally Stable

The resistance to creep, as discussed in the preceding paragraph, addresses the dimensional stability of the tensioning assembly. Another aspect of dimensional stability pertains to dimension changes as a function of temperature. Most materials are dimensionally sensitive to temperature changes. That is, when the temperature of an item, for example a rod, changes, the length of the rod also changes. Thus the material of which the rod is constructed, has a non-zero coefficient of thermal expansion, or CTE. The CTE is material specific and changes depending on the temperature range that the material is at. The dimensional change (in this example the length) due to temperature changes would be computed as:

$$\text{Change in length}(\Delta L)=\text{original length}(L)\times\text{CTE}(\alpha(T))\times\text{change in temperature}(\Delta T)$$

$$\Delta L = L\int_A^B \alpha(T)\,dT$$

A tension member using a material having a low CTE would deviate least from its original dimension. The consequence of selecting a material without giving any thought to its CTE is that the desired applied load may change as a result of lengthening or shortening of the load member relative to the shaft due to temperature changes. This would change the adjusted setting of the tension member resulting in unintended changes in the shaft's bending characteristics. Therefore a properly selected material is necessary to ensure stability in the shaft's adjusted bending properties.

Material Selection

There are many choices of materials with which to construct the tension member, however three classes of materials provide performance that significantly exceed any material discussed in prior art. One such material is a type of liquid crystal polymer (LCP) known by the tradename of Vectran. Another material is Zylon, otherwise known as PBO (short for poly(p-phenylene-2,6-benzobisoxazole)). The third class of material is carbon fiber. Vectran, Zylon, and carbon fiber exhibit properties that make them ideally suited for use in this application. Vectran and Zylon have densities of less than 0.058 lb/in$^3$ with ultimate tensile strengths of greater than 400,000 psi. Carbon fiber, depending on the specific type, commonly has a density of less than 0.065 lb/in$^3$ with ultimate tensile strengths of greater than 500,000 psi. This combination of high strength and low density make Vectran, Zylon, and carbon fiber much more weight efficient in carrying loads than steel. Zylon, Vectran, and carbon fiber exhibit very little to zero creep. Zylon, Vectran, and carbon fiber have CTEs of almost zero. Zylon, Vectran, and carbon fiber are much less abrasive on the interior wall of the golf shaft when compared to metallic cable. Vectran and Zylon have excellent damping characteristics and both materials are very resistant to flex fatigue failure. Because of these properties, Zylon, Vectran, and carbon fiber are unique materials for use in the tension member of the tension adjuster assembly.

The use of Zylon, Vectran, or carbon fiber as the tension member has its difficulties. The biggest challenge is to design a method of attaching the fiber to end fittings that will then be attached to the inner wall of the golf club shaft. The preferred embodiment uses a potted, or glued end fitting. The end fitting is designed to have a tapered inner bore through which the fibers are passed. The fibers are then splayed out and a bonding agent, such as epoxy, is spread onto the fibers and the inner wall of the tapered bore. A plug of epoxy and fibers is then trapped within the tapered inner bore. When tension is applied to the tension member with the end fitting held, the plug tries to expand the end fitting in a circumferential fashion but is resisted by the hoop stiffness of the end fitting. Thus, the end fitting must be made of a material that tolerates tensile loads. The end fitting can consist of either a universal end fitting to which a specific insert can be attached, or it can be the final insert that will be attached to the inner wall of the golf shaft.

A bonded cable end termination has the addition benefit of compactness. Since the fibers of the tension member enter the end fitting straight on, the end fitting needs only be as large as necessary to get sufficient taper to allow the epoxy plug to remain trapped. This eliminates the need to double over the tension member material as with loop end cables. If the selected cable material is made up of untwisted fibers, the added benefit is that the individual fibers of the tension member are of a uniform loaded length and tension. This allows the material to work more efficiently. Twisted or braided cable could also be used, however the fiber strands would not necessarily see equal loading.

Another benefit of using Vectran, Zylon, or carbon fiber for the tension member is that all of these materials exhibit high damping qualities. The benefit of a tension member with high damping is that the lateral vibration decays rapidly so there is no "buzzing" felt when the golf ball is struck. Also, even if the Vectran, Zylon, or carbon fiber tension member were to strike the side of the golf club shaft, less noise would be generated than if a metallic cable were used. Since the Vectran, Zylon, or carbon fiber tension member has such low mass, inertia loading is minimized. The inertia loading occurs when the golf club shaft is moving and then suddenly decelerates, such as when the golf ball is struck. At this instant, the inertia of the tension member causes the tension member to stretch itself beyond its original length. Therefore the lower the mass of the tension member, the less the inertia loading.

As described in U.S. patent application Ser. No. 10/208,109, the tensioning assembly can be located entirely within the golf shaft. In one embodiment, the fixed insert and the adjustable insert are sized to fit entirely within the golf shaft cavity and fixed to the cavity by bonding with epoxy or some other adhesive. In this case it is necessary to size the fixed insert and the adjustable insert to have a close fit to the inner wall of the golf shaft in order to have a thin and consistent film of adhesive around the entire circumference of the inserts. To aid in ensuring that the adhesive film is thin and consistent, it may be desirable to form raised ridges, rings, or bumps on the outer surface of the inserts in order to create a controlled space to permit a thin film of adhesive to adhere to the inside wall of the golf shaft and the outer surface of the inserts. The protrusions can be formed on the inserts during manufacturer, or they can be added at a later time. One way to add a ring would be to install an O-ring type of washer to the insert. Another way would be to add a piece of compressible foam tape. If a ring is used on the adjustable insert, there is the added benefit of preventing the adhesive from oozing onto the seat of the adjusting screw.

Another attribute of this tension adjusting assembly is that the tension member does not twist when the adjusting screw is turned. This is achieved by making the inner bore of the adjuster non-circular so that torsion loads can be reacted. Prior art suggested using counter-rotating threads to neutralize the twisting tendency. The benefit of preventing the tension member from twisting is that all of the fibers participate in load carrying. If twist were allowed to occur, the central fibers would remain straight but the fibers at the outside of the tension member would become coiled, thereby shortening the length of the tension member. Thus it can be seen that the central fibers would be supporting less load. Another beneficial characteristic of Vectran, Zylon and carbon fiber these or other synthetic fibers resist corrosion when used in moist or wet environments, especially ones with salt water. This synthetic fiber adjuster assembly can be used in water skis, snow skis, surf boards, windsurf boards, kite boards, ski poles, hockey sticks, bicycle frames, skate boards or any other type of sport apparatus in which the flex of the sports equipment is important.

Description of Lightweight Tensioning Assembly Invention Embodiment

In the enclosed diagram, the preferred embodiment of a lightweight tensioning assembly is shown. The tension member 1005 is bonded to the end fittings 1001 and 1002 by expanding the fibers, applying adhesive, and forcing the wetted fibers back into the tapered holes 1003 and 1004. Ridges 1006, 1706, or 1806 are machined, formed, or assembled into the outer surface of the inserts 1007 and 1008, which are bonded to the inside of the shafts. The ridges are to help ensure that there is a uniform bond line between the inserts and the interior of the shaft. In one embodiment, the ridges are created by adhering tape, 1706 to the insert. In another embodiment, the ridges are created by installing an o-ring 1806 into a groove. In one embodiment, the insert 1007 and the bonded end fitting 1001 can be connected via a threaded interface 1010. However, it is not a requirement that the insert 1007 and the bonded end fitting 1001 are separate pieces. It is possible to make the insert 1007 and the bonded end fitting 1001 as one piece 1115. The ridge 1011 nearest the adjusting cap 1009 also provides the function of preventing the adhesive from contaminating the seating surface between the insert 1008 and the adjusting cap 1009. Each of the parts contained in the embodiment herein, are designed to be manufacturable on a screw machine without the need of reversing and re-inserting the partially machined piece. This provides the benefit of eliminating a manufacturing step, thus reducing the price of the assembly. The interior orifice of the insert 1008 and 1608 has a non-circular shape 1621. The outer surface of the bonded end fitting 1002 and 1602 has a complimentary shape 1620, but slightly undersized. These two features provide a means for preventing the bonded insert 1002 and 1602 from rotating when the adjusting cap 1009 is turned. Thus the bonded insert 1002 and 1602 is restricted to move in only a linear path. This motion provides the tension on the tension member 1005 which in turn applies a compressive force on the supporting shaft in which this device is installed. The internal orifice shape of insert 1008 and 1608 can be any of a variety of non-circular shapes. The embodiment shown utilizes a hex shape but a D-shape, or square, or star, or spline, etc. would all provide the necessary properties of preventing rotation. Thus the only requirement is that the shape be non-circular.

An alternate embodiment incorporates a female threaded bonded end fitting 1216 and a male threaded adjusting screw 1217.

Method and Device for Assembling Adjustable Flex Golf Club Shafts

The assembly of the Adjustable Flex Golf Club Shaft is difficult due to the access limitations of a long tapered tube. A golf club shaft can be fifty or more inches long and the inner insert of the tensioning assembly may have to be positioned forty five or more inches in from the butt of the shaft. Mass production of the Adjustable Flex Golf Club Shaft requires a rapid, repeatable and accurate method for positioning the tensioning assembly. It is also desirable to incorporate an assembly methodology that compensates for any tolerance buildup that may occur in the manufacture of the tensioning assembly. In particular, the length of the tensioning assembly may be difficult to control due to the handling characteristics of flexible cable.

Since the load member of the tensioning assembly consists of a flexible cable, placement of the tensioning assembly by pushing or dropping the tensioning assembly through the larger butt end of the tapered shaft could result in the cable being in a relaxed state. The degree of relaxation could vary from one installation to the next. One way to overcome this deficiency would be to assemble the Adjustable Flex Golf Club Shaft by pulling the tensioning assembly into the shaft thereby ensuring that the tensioning cable would be extended once the inserts were seated and secured. This also guarantees that each shaft assembly would require the same number of turns of the adjustment screw until the onset of cable tension.

Since the tip of the golf club shaft is quite small compared to the butt of the shaft, any device for pulling the tensioning assembly into the golf club shaft would have to be of sufficiently small dimension so that it could be removed after the assembly had been completed. The device can be disposable or reusable. One embodiment is a rod with a threaded end 1318 and 1319 that will capture the inner-most insert 1326 and draw the tensioning assembly into the golf club shaft. Another embodiment of the installation rod incorporates a capture design that locks the installation tool 1321 in place until the operator releases it by releasing a locking mechanism 1320. More specifically, when the internal rod 1320 is retracted, the outer portion of the tool 1321 is able to collapse to a smaller diameter enabling it to be inserted or removed from the insert 1326. Still another embodiment is for a disposable installation rod 1322 that incorporates a break-away feature 1327 such as a necked down area. This installation rod 1322 is designed to capture the inner insert 1326 by pressing the installation rod 1322 in place until the barbs 1328 on the installation rod capture the inner insert 1326. After the installation and bonding is complete, the installation rod 1324 is pulled and broken free of the tip of the installation rod 1325 at a pre-determined force. The piece of the installation rod 1325 remains with the insert 1326 and the remainder of the disposable installation rod 1324 is disposed of.

The installation rods that have been described above all rely on having a bonding agent in place before the tension adjusting assembly is pulled into the golf club shaft. These aforementioned installation rods would also work with self-locking inserts. Another embodiment of the installation tool incorporates the feature a central lumen 1433 that enters the insert, which contains a plurality of pores 1432. The central lumen 1433 is used to inject adhesive into the insert 1431 until the adhesive escapes through a plurality of pores 1432 and is captured between the outer surface of the insert and the inner surface of the golf club shaft. In this embodiment, the installation tool serves to simultaneously position the tension adjusting assembly while bonding the assembly to the golf club shaft. The aforementioned assembly procedure depends on the outer most insert, i.e. the insert at the opposite end of the tensioning assembly from the installation tool, to seat so that a tension can be developed within the cable. If there is a misfit between the outer insert and the golf club shaft, the outer insert may not seat at its intended position. One way to remedy this problem is to incorporate another installation tool to hold the outer insert in order to be able to control its position while it is being bonded to the golf club shaft. The length of the installations tool, as well as the length of the installation tool used in the inner insert end, must be sufficiently long so as to remain accessible from outside the golf club shaft during the installation procedure. An embodiment is shown for an installation tool to be used on the adjuster insert 1535. The installation tool 1534 should be able to firmly hold the adjuster insert 1535 using a means such as a screw thread interface 1536. This is necessary for two reasons. The first reason is that the adjuster insert 1535 should be pulled away from the inner insert in order to maintain a tension on the tension member 1538. The second reason is that the installation tool will protect the bearing surface 1537 from becoming contaminated with adhesive. This will ensure smooth operation of the adjusting screw 1009 and 1217.

The installation tools have been described as being used on "inner" and "outer" inserts. There may be occasions when the adjuster insert will be placed toward the tip end of the golf club shaft and the non-adjuster insert will be placed toward the butt end of the golf club shaft. In this case, the embodiments for the installation tools are still applicable, however they must be sized accordingly.

The installation method thus calls for the inner insert of the tension adjuster assembly being attached to an installation tool of proper diameter so as to be removable through the tip end of the golf club shaft. The installation tool is inserted in the butt of the golf club shaft and the tension adjuster assembly is pulled into the golf club shaft until the outer insert seats or is stopped via an installation tool attached to outer insert. Adhesive may have been applied prior to pulling the tension adjuster assembly into the golf club shaft, or it may be applied once the inserts are located in their final position within the golf club shaft.

What is claimed:

1. A flexible lightweight tensioning assembly to be coupled to a golf shaft for the purpose of inducing a compressive load on the golf shaft comprising:

a flexible non-metallic creep resistant load member of a prescribed length with one end and a second end, and a first end fitting, and a second end fitting, the second end fitting having a non-circular outer cross section, and a first insert, and a second insert, the second insert having a non-circular internal orifice;

the first end fitting bonded with adhesive or potted with adhesive to the one end of the load member;

the second end fitting bonded with adhesive or potted with adhesive to the second end of the load member, the first insert coupled to the first end fitting, and the second end fitting disposed within the second insert.

2. The flexible lightweight tensioning assembly of claim 1 in which the load member is made of a liquid crystal polymer.

3. The flexible lightweight tensioning assembly of claim 1 in which the load member is made of Vectran.

4. The flexible lightweight tensioning assembly of claim 1 in which the load member is made of Zylon.

5. The flexible lightweight tensioning assembly of claim 1 in which the load member is made of a carbon fiber.

6. The flexible lightweight tensioning assembly of claim 1 in which the load member is made of a material in the liquid crystal polymer class of fibers.

7. The flexible lightweight tensioning assembly of claim 1 in which the load member is made of a material in the carbon fiber class of fibers.

8. A flexible lightweight tensioning assembly to be coupled to a golf shaft for the purpose of inducing a compressive load on the golf shaft comprising:

a flexible non-metallic creep resistant load member of a prescribed length with one end and a second end, and a first end fitting, and a second end fitting, the second end fitting having a non-circular outer cross section, and an insert, the insert having a non-circular internal orifice;

the first end fitting bonded with adhesive or potted with adhesive to the one end of the load member;

the second end fitting bonded with adhesive or potted with adhesive to the second end of the load member, the second end fitting disposed within the insert.

9. The flexible lightweight tensioning assembly of claim 8 in which the load member is made of a liquid crystal polymer.

10. The flexible lightweight tensioning assembly of claim 8 in which the load member is made of Vectran.

11. The flexible lightweight tensioning assembly of claim 8 in which the load member is made of Zylon.

12. The flexible lightweight tensioning assembly of claim 8 in which the load member is made of a carbon fiber.

13. The flexible lightweight tensioning assembly of claim 8 in which the load member is made of a material in the liquid crystal polymer class of fibers.

14. The flexible lightweight tensioning assembly of claim 8 in which the load member is made of a material in the carbon fiber class of fibers.

* * * * *